US007507307B2

(12) United States Patent
Hasegawa et al.

(10) Patent No.: US 7,507,307 B2
(45) Date of Patent: Mar. 24, 2009

(54) METHOD FOR PRODUCING COLD ROLLED STEEL PLATE OF SUPER HIGH STRENGTH

(75) Inventors: Kohei Hasegawa, Hiroshima (JP); Nobuyuki Nakamura, Hiroshima (JP); Toshiaki Urabe, Chiba (JP)

(73) Assignee: JFE Steel Corporation, Tokyo (JP)

( * ) Notice: Subject to any disclaimer, the term of this patent is extended or adjusted under 35 U.S.C. 154(b) by 278 days.

(21) Appl. No.: 10/485,229

(22) PCT Filed: Jun. 6, 2003

(86) PCT No.: PCT/JP03/07215

§ 371 (c)(1),
(2), (4) Date: Mar. 29, 2004

(87) PCT Pub. No.: WO03/104499

PCT Pub. Date: Dec. 18, 2003

(65) Prior Publication Data

US 2004/0177905 A1 Sep. 16, 2004

(30) Foreign Application Priority Data

Jun. 10, 2002 (JP) ..... 2002-168210

(51) Int. Cl.
*C21D 8/02* (2006.01)

(52) U.S. Cl. ..... 148/603; 148/602; 148/661; 148/663; 148/652

(58) Field of Classification Search ..... 148/602, 148/603, 661, 652, 663, 547
See application file for complete search history.

(56) References Cited

U.S. PATENT DOCUMENTS 4,323,403 A * 4/1982 Nakaoka et al. ..... 148/622
6,676,774 B2 1/2004 Matsuoka et al.
6,695,933 B2 * 2/2004 Hasegawa et al. ..... 148/320
6,818,074 B2 11/2004 Matsuoka et al.
2004/0238082 A1 12/2004 Hasegawa et al.

FOREIGN PATENT DOCUMENTS

EP 0 360 955 A2 4/1990

(Continued)

OTHER PUBLICATIONS

ASM Internation, Materials Park, Ohio, Metallographer's Guide: Practices and Procedures for Irons and steels, Chapter 1, "Introduction to Steels and Cast Irons", p. 3. 1998.*

(Continued)

*Primary Examiner*—Deborah Yee
(74) *Attorney, Agent, or Firm*—Frishauf, Holtz, Goodman & Chick, P.C.

(57) ABSTRACT

The present invention provides a method for manufacturing an ultra high strength cold-rolled steel sheet, comprising the step of continuously annealing a cold-rolled steel sheet consisting essentially of, in terms of weight percentages, 0.07 to 0.15% C, 0.7 to 2% Si, 1.8 to 3% Mn, 0.02% or less P, 0.01% or less S, 0.01 to 0.1% Sol. Al, 0.005% or less N, 0.0003 to 0.003% B, and the balance being Fe, in which such continuous annealing comprises the steps of: heating the cold-rolled steel sheet at from 800° C. to 870° C. for 10 seconds or more; slowly cooling the heated steel sheet down to from 650° C. to 750° C.; rapidly cooling the slowly cooled steel sheet down to 100° C. or less at a cooling speed of over 500° C./sec; reheating the rapidly cooled steel sheet at from 325° C. to 425° C. for from 5 minutes to 20 minutes; cooling the reheated steel sheet down to room temperature; and coiling the cooled steel sheet. According to the invention, the ultra high strength cold-rolled steel sheet, for use in a structural member of automobile, which has a tensile strength of 980 MPa or more and is excellent in stretch-flangeability, ductility, and spot-weldability can be obtained.

18 Claims, 1 Drawing Sheet

FOREIGN PATENT DOCUMENTS

| | | | | |
|---|---|---|---|---|
| EP | 1 201 780 | A1 | | 5/2002 |
| GB | 2 195 658 | A | | 4/1988 |
| JP | 55-22532 | B2 | | 4/1975 |
| JP | 55-51410 | B2 | | 8/1975 |
| JP | 58-55219 | B2 | | 12/1983 |
| JP | 7-68583 | B2 | | 9/1985 |
| JP | 1-35051 | B2 | | 1/1986 |
| JP | 6-13533 | A | | 1/1987 |
| JP | 62-13533 | A | | 1/1987 |
| JP | 5-57332 | B2 | | 2/1987 |
| JP | 1-35052 | B2 | | 5/1987 |
| JP | 63-14817 | A | | 1/1988 |
| JP | 3-68927 | B2 | | 6/1988 |
| JP | 7-74412 | B2 | | 7/1988 |
| JP | 63-241115 | A | | 10/1988 |
| JP | 7-59726 | B2 | | 11/1988 |
| JP | 63-293121 | A | | 11/1988 |
| JP | 1-92317 | A | | 4/1989 |
| JP | 2766693 | B2 | | 9/1991 |
| JP | 3-277743 | A | | 12/1991 |
| JP | 4-99227 | A | | 3/1992 |
| JP | 8-30212 | B2 | | 3/1992 |
| JP | 4-333524 | A | | 11/1992 |
| JP | 2545316 | B2 | | 5/1993 |
| JP | 6-271942 | | * | 9/1994 |
| JP | 7-090488 | | * | 4/1995 |
| JP | 7-197183 | | * | 8/1995 |
| JP | 8-3677 | A | | 1/1996 |
| JP | 8-134549 | | * | 5/1996 |
| JP | 9-41040 | A | | 2/1997 |
| JP | 9-263838 | A | | 10/1997 |
| JP | 10-60593 | A | | 3/1998 |
| JP | 10-147838 | A | | 6/1998 |
| JP | 11-350038 | A | | 12/1999 |
| JP | 2000-017385 | A | | 1/2000 |
| JP | 2001-226741 | A | | 8/2001 |
| JP | 2001-335890 | A | | 12/2001 |
| JP | 2001-355044 | A | | 12/2001 |
| JP | 2002-161336 | A | | 6/2002 |
| WO | WO 02/22904 | A1 | | 3/2002 |

OTHER PUBLICATIONS

English translation of Japanese patent 06271942, Yasunobu Nagataki et al., Sep. 27, 1994.*

Koji Kishida, "High-Strength Steel Sheets for Light Weight Vehicle," Nippon Steel Technical Report No. 371, pp. 13-17, (1999).

Kohei Hasegawa et al., Effects of Microstructure on Stretch-flange-formability of 980 MPa Grade Cold-rolled Ultra High Strength Steel Sheets, *ISIJ International*, vol. 44, (2004), No. 3, pp. 603-609.

* cited by examiner

METHOD FOR PRODUCING COLD ROLLED STEEL PLATE OF SUPER HIGH STRENGTH

This application is the United States national phase application of International Application PCT/JP03/07215 filed Jun. 6, 2003.

TECHNICAL FIELD

The present invention relates to a method for manufacturing an ultra high strength cold-rolled steel sheet, favorable for use in a structural member of machine, particularly in a structural member of automobile, which has a tensile strength of 980 MPa or more and is excellent in stretch-flangeability and spot-weldability.

BACKGROUND ART

From the point of view of achieving weight reduction of automobile for the purpose of reduction in fuel consumption and ensuring safety for occupants of automobile, application of an ultra high strength cold-rolled steel sheet having a tensile strength of 980 MPa or more to a structural member of automobile has been studied. However, since such an ultra high strength cold-rolled steel sheet as described above is remarkably inferior to a mild cold-rolled steel sheet in stretch-flangeability and ductility, it is difficult to subject the ultra high strength cold-rolled steel sheet to press-forming.

In regard to formability of a high strength cold-rolled steel sheet, a number of prior arts have so far been disclosed, for example, in JP-B Nos. 7-59726, 55-22532, 55-51410, 1-35051, and 1-35052, Japanese Patent No. 2766693, and JP-B No. 8-30212.

However, except for a case in which C content is high, among these prior arts, there is no prior art which simultaneously achieves a tensile strength of 980 MPa or more and either excellent stretch-flangeability or ductility. In a case in which C content is high, there is a problem in that, since a spot-welded portion is liable to be fractured, sufficient joint strength can not be obtained.

DISCLOSURE OF THE INVENTION

An object of the present invention is to provide a method for manufacturing an ultra high strength cold-rolled steel sheet, for use in a structural member of automobile, which has a tensile strength of 980 MPa or more and is excellent in stretch-flangeability, ductility, and spot-weldability.

This object is achieved by a method for manufacturing an ultra high strength cold-rolled steel sheet, comprising the step of continuously annealing a cold-rolled steel sheet consisting essentially of, in terms of weight percentages, 0.07 to 0.15% C, 0.7 to 2% Si, 1.8 to 3% Mn, 0.02% or less P, 0.01% or less S, 0.01 to 0.1% Sol. Al, 0.005% or less N, 0.0003 to 0.003% B, and the balance being Fe, in which such continuous annealing comprises the steps of:

heating the cold-rolled steel sheet at from 800° C. to 870° C. for 10 seconds or more;

slowly cooling the heated steel sheet down to from 650° C. to 750° C.;

rapidly cooling the slowly cooled steel sheet down to 100° C. or less at a cooling speed of over 500° C./sec;

reheating the rapidly cooled steel sheet at from 325° C. to 425° C. for from 5 to 20 minutes;

cooling the reheated steel sheet down to room temperature; and coiling the cooled steel sheet.

EMBODIMENTS OF THE INVENTION

Figure 1:
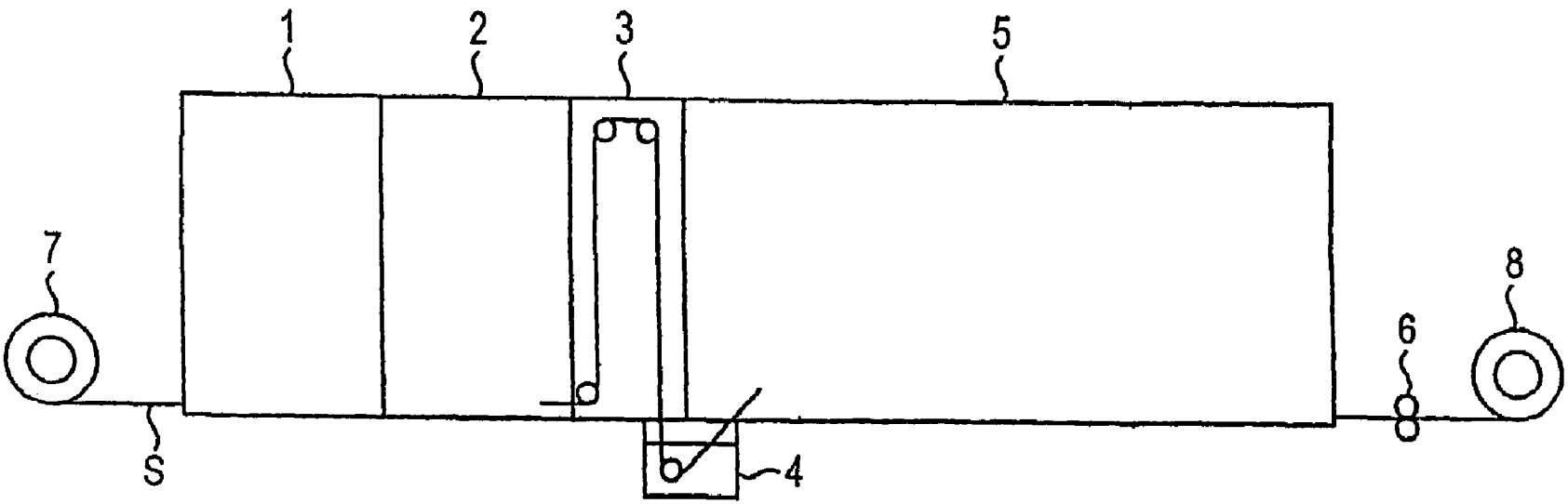
FIG. 1 is a diagram showing a constitution of an actual continuous annealing furnace.

FIG. 1 shows a constitution of an actual continuous annealing furnace.

The continuous annealing furnace comprises a heating zone 1 for heating a steel sheet S, a soaking zone 2 for holding the heated steel sheet S at a heating temperature, a slow cooling zone (gas jet zone) 3 for slowly cooling the soaked steel sheet S, a rapid cooling zone 4 for rapidly cooling the slowly cooled steel sheet S, and an overaging zone 5 for subjecting the rapidly cooled steel sheet S to overaging (tempering) treatment. The steel sheet S which is supplied from a cold-rolled coil 7 at an inlet side passes through the heating zone 1, the soaking zone 2, the slow cooling zone 3, the rapid cooling zone 4 and the overaging zone 5 to be continuously subjected to heating, soaking, slow cooling, rapid cooling and overaging treatments, respectively, and, after optionally subjected to temper-rolling by a temper-rolling mill 6 at an outlet side, coiled to be a coil 8.

In the slow cooling zone 3 located between the soaking zone 2 and the rapid cooling zone 4, a temperature of the steel sheet is unavoidably decreased by 100° C. or more. In a conventional ultra high strength cold-rolled steel sheet of ferrite-martensite dual-phase type, excess amount of ferrite is unavoidably generated during the period in which the steel sheet passes through the slow cooling zone 3, thereby decreasing strength thereof. Therefore, conventionally, in a case in which, after the steel sheet is rapidly cooled, it is subjected to overaging treatment at 325° C. or more for the purpose of enhancing stretch-flangeability, it is essential to increase amount of C or decrease amount of Si for increasing strength and, accordingly, spot-weldability or ductility is unavoidably deteriorated.

Under these circumstances, the present inventors have exerted an intensive study on structure formation of the steel sheet by using the continuous annealing furnace and, as a result, have found that, in order to obtain a tensile strength of 980 MPa or more without increasing amount of C which deteriorates spot-weldability and, also, without decreasing amount of Si which is essential for enhancing ductility, structure control in the slow cooling step which is disposed between the steps of soaking and rapid cooling, namely, suppression of transformation of austenite into ferrite is important.

Further, it has also been found that, in order to suppress such transformation as described above, it is extremely effective to add 0.0003 to 0.003% B and, still further, it is particularly effective to add at least one element selected from 0.003 to 0.03% Ti and 0.1 to 1% Mo.

Hereinafter, such findings will be described in detail.

(1) Compositions

C: C is an important element for strengthening martensite in a quenched state. When amount of C is less than 0.07%, a strength of 980 MPa or more can not be obtained, while, when it is over 0.15%, spot-weldability is deteriorated. Accordingly, amount of C is set to be 0.07 to 0.15%.

Si: Si is effective for enhancing ductility of a steel sheet of ferrite-martensite dual-phase type. When amount of Si is less than 0.7%, effectiveness thereof is insufficient, while, when it is over 2%, large amount of Si oxide is formed on a surface of the steel sheet, thereby deteriorating phosphatability of the steel sheet. Accordingly, amount of Si is set to be 0.7 to 2%.

Mn: Mn is an important element for suppressing generation of ferrite at the time of slow cooling in the continuous annealing. When amount of Mn is less than 1.8%, effectiveness thereof is insufficient, while, when it is over 3%, cracks are frequently generated at the time of producing a slab by means of continuous casting. Accordingly, amount of Mn is set to be 1.8 to 3%.

P: when amount of P is over 0.02%, spot-weldability is remarkably deteriorated. Accordingly, amount of P is set to be 0.02% or less.

S: when amount of S is over 0.01%, spot-weldability is remarkably deteriorated. Accordingly, amount of S is set to be 0.01% or less.

Sol. Al: Al is added for deoxidizing a steel and, also, precipitating N as AMN. When amount of Sol. Al is less than 0.01%, effectiveness thereof is insufficient, while, when it is over 0.1%, effectiveness is only saturated, thereby being uneconomical. Accordingly, amount of Sol. Al is set to be 0.01 to 0.1%.

N: since N deteriorates formability of the steel sheet, it is desirable that N is removed or reduced as much as possible in steel making process. However, when it is reduced more than necessary, a refining cost is elevated. Accordingly, amount of N is set to be 0.005% or less which raises no substantial problem in formability.

B: B is the most important element in the present invention. It exhibits a remarkable effectiveness in suppressing generation of ferrite at the time of slow cooling in the continuous annealing. However, when amount thereof is less than 0.0003%, effectiveness thereof is insufficient, while, when it is over 0.003%, effectiveness of addition of B is only saturated, thereby deteriorating productivity of the steel sheet. Accordingly, amount of B is set to be 0.0003 to 0.003%.

Further, the balance is Fe.

Besides these elements, when at least one element selected from 0.003 to 0.03% Ti and 0.1 to 1% Mo is further added, transformation of austenite into ferrite can more effectively be suppressed. Amounts of Ti and Mo are so limited due to the reason as described below.

Ti: when solid solution N is present in the steel, B is precipitated as BN, thereby deteriorating the effectiveness of suppressing transformation to be caused by the above-described addition of B. Therefore, by adding Ti together with B, N is allowed to be precipitated in advance as TiN, thereby enhancing the effectiveness of B. However, when amount of Ti is less than 0.003%, the effectiveness is insufficient, while, when it is over 0.03%, TiC is precipitated, thereby deteriorating formability of the steel. Accordingly, when Ti is added, amount thereof is set to be 0.003 to 0.03%.

Mo: Mo is effective in suppressing generation of ferrite at the time of slow cooling in the continuous annealing. However, when amount 0.5 thereof is less than 0.1%, effectiveness thereof is insufficient, while, when it is over 1%, the effectiveness is only saturated, thereby leading to a cost increase. Accordingly, when Mo is added, amount thereof is set to be 0.1 to 1%.

(2) Manufacturing Conditions

In a method for manufacturing an ultra high strength cold-rolled steel sheet according to the present invention, the cold-rolled steel sheet having the above-described compositions is annealed in a continuous annealing furnace. In the continuous annealing furnace, the cold-rolled steel sheet is, in the order described below, heated at from 800° C. to 870° C. for 10 seconds or more, slowly cooled down to from 650° C. to 750° C., rapidly cooled down to 100° C. or less at a cooling speed of over 500° C./sec, reheated at from 325° C. to 425° C. for from 5 minutes to 20 minutes, cooled down to room temperature and, then, coiled.

The reason why heating is performed at from 800° C. to 870° C. for 10 seconds or more is that, when heating temperature is less than 800° C. or heating time is less than 10 seconds, sufficient amount of austenite is not generated and, accordingly, high strength can not be obtained, while, when heating temperature is over 870° C., a single phase of austenite is generated and, then, structure comes to be coarse, thereby deteriorating ductility and stretch-flangeability.

The reason why the slow cooling is performed down to from 650° C. to 750° C. after heating is that appropriate amount of ferrite is generated in this step, thereby enhancing ductility and also adjusting strength. When slow cooling terminal temperature is less than 650° C., ferrite is excessively generated to allow strength to be insufficient, while, when it is over 750° C., flatness of the steel sheet is deteriorated by subsequent rapid cooling. The cooling speed at the time of the slow cooling is set to be less than 20° C./sec and preferably from 5° C./sec to 15° C./sec.

Rapid cooling is performed after the slow cooling. When cooling speed at the time of the rapid cooling is 500° C./sec or less, quenching is not sufficiently performed, thereby being incapable of obtaining sufficient strength. When rapid cooling terminal temperature is over 100° C., austenite remains, thereby deteriorating stretch-flangeability.

After the rapid cooling, reheating is performed at from 325° C. to 425° C. for from 5 minutes to 20 minutes. This is conducted for the purpose of tempering martensite which has been generated in the previous rapid cooling step, thereby enhancing ductility and stretch-flangeability. When reheating temperature is less than 325° C. or reheating time is less than 5 minutes, such effectiveness as described above comes to be insufficient. Further, when reheating temperature is over 425° C. or reheating time is over 20 minutes, strength, is remarkably reduced and, accordingly, it becomes difficult to achieve a tensile strength of 980 MPa or more.

The steel sheet before subjected to the annealing is produced such that a slab which has been produced by continuous casting method or ingot making method is hot-rolled after cooled and reheated, or directly, and then cold-rolled. Finish rolling temperature (finishing temperature) in such hot-rolling is preferably from Ar3 transformation temperature to 870° C. in order to enhance ductility and stretch-flangeability by allowing structure to be finer. Further, temperature at the time of coiling to be performed after the hot-rolling is preferably 620° C. or less in order to enhance ductility and stretch-flangeability by allowing structure to be finer. Rolling reduction rate at the time of cold-rolling is preferably 55% or more in order to enhance ductility and stretch-flangeability by allowing structure to be finer. After the continuous annealing, when temper-rolling is performed further at a rolling reduction rate of 0.1 to 0.7%, yield elongation of the steel sheet can be eliminated. Further, the resultant cold-rolled steel sheet can be subjected to electroplating or applied with solid lubricant or the like.

EXAMPLE 1

Steel Nos. 1 to 10 having respective chemical compositions as shown in Table 1 were each melted and cast into a slab. The slab was heated at 1250° C. and hot-rolled at a finishing temperature of about 870° C. The resultant hot-rolled steel sheet was cooled at a cooling speed of about 20° C./sec, and heated at 600° C. for one hour followed by furnace cooling to simulate coiling. Subsequently, the hot-rolled steel sheet was cold-rolled to a thickness of 1.2 mm, and subjected to heat treatment which simulated continuous annealing, thereby producing cold-rolled steel sheet Nos. 1 to 10. Continuous annealing conditions are such that the cold-rolled steel sheet was heated at a heating speed of about 20° C./sec, soaked at 830° C. for 300 seconds, slowly cooled down to 700° C. at a cooling speed of about 10° C./sec, rapidly cooled in jet-flowing water, subjected to reheating (tempering) treatment at 400° C. for 10 minutes, and, finally, subjected to temper-rolling of 0.3%. The cooling speed at the time of such rapid cooling in jet-flowing water was about 2000° C./sec.

The measurement of characteristics as described below was conducted on the thus produced cold-rolled steel sheets.

Tensile characteristics: a JIS No. 5 test piece (JIS Z 2201) was obtained from each of a rolling direction and a direction at a right angle thereto and subjected to tensile test, in accordance with JIS Z 2241, in which yield strength (YP), tensile strength (TS), and elongation (El) were measured.

Stretch-flangeability: a hole-expanding test was performed in accordance with the Japan Iron and Steel Federation Standard (JFST 1001-1996) and hole-expanding ratio λ was measured.

Spot-weldability: welding was performed under a condition that a nugget diameter came to be 4.9 mm (4.5×sheet thickness$^{1/2}$) and, then, tensile shear strength and cross tensile strength were measured.

So long as the steel sheet has an elongation of 15% or more, a hole-expanding ratio of 60% or more, a tensile shear strength of 12 kN or more, and a cross tensile strength of 6 kN or more, the steel sheet can be used in a structural member of actual automobile.

The results are shown in Table 2.

Steel sheet Nos. 2, 3, 6, 9, and 10 which are examples according to the present invention each have a tensile strength of 980 MPa or more and are excellent in stretch-flangeability, ductility, and spot-weldability.

On the other hand, steel sheet Nos. 1, 4, 5, 7, and 8 as Comparative Examples are each inferior in at least one of these characteristics. For example, in the steel sheet No. 1, since amount of C is small, tensile strength, hole-expanding ratio, and tensile shear strength are low. In the steel sheet No. 4, since amount of C is large, cross tensile strength is low. It is considered that this was caused by the fact that a welded portion was excessively hardened and an inside of the welded portion was fractured based on brittleness. In the steel sheet No. 5, since amount of Si is small, elongation or hole-expanding ratio is low. In the steel sheet No. 7, since amount of Mn is small, tensile strength and hole-expanding ratio are low. In the steel sheet No. 8, since amount of B is small, tensile strength and hole-expanding ratio are low.

TABLE 1

| | Chemical compositions (wt. %) | | | | | | | | | | |
|---|---|---|---|---|---|---|---|---|---|---|---|
| Steel No. | C | Si | Mn | P | S | Sol. Al | N | B | Ti | Mo | Remark |
| 1 | 0.05 | 1.0 | 2.0 | 0.010 | 0.003 | 0.030 | 0.003 | 0.0010 | <0.001 | <0.001 | Comparative Example |
| 2 | 0.08 | 1.0 | 2.3 | 0.010 | 0.003 | 0.030 | 0.003 | 0.0010 | <0.001 | <0.001 | Present Invention |
| 3 | 0.12 | 1.0 | 2.1 | 0.010 | 0.003 | 0.030 | 0.003 | 0.0010 | <0.001 | <0.001 | Present Invention |
| 4 | 0.16 | 1.4 | 2.0 | 0.006 | 0.001 | 0.030 | 0.003 | 0.0010 | <0.001 | <0.001 | Comparative Example |
| 5 | 0.09 | 0.2 | 2.2 | 0.010 | 0.003 | 0.030 | 0.003 | 0.0010 | <0.001 | <0.001 | Comparative Example |
| 6 | 0.13 | 1.4 | 1.9 | 0.010 | 0.003 | 0.030 | 0.003 | 0.0010 | <0.001 | <0.001 | Present Invention |
| 7 | 0.12 | 1.0 | 1.7 | 0.010 | 0.003 | 0.030 | 0.003 | 0.0010 | <0.001 | <0.001 | Comparative Example |
| 8 | 0.12 | 1.0 | 2.0 | 0.010 | 0.003 | 0.030 | 0.003 | 0.0002 | <0.001 | <0.001 | Comparative Example |
| 9 | 0.12 | 1.0 | 2.2 | 0.010 | 0.003 | 0.030 | 0.003 | 0.0010 | 0.020 | <0.001 | Present Invention |
| 10 | 0.12 | 1.0 | 1.9 | 0.010 | 0.003 | 0.030 | 0.003 | 0.0010 | <0.001 | 0.30 | Present Invention |

Underlined figures denote those outside the scope of the present invention

TABLE 2

| | | Tensile characteristics | | | Stretch-flangeability | Spot-weldability | | |
|---|---|---|---|---|---|---|---|---|
| Steel sheet No. | Steel No. | YS (MPa) | TS (MPa) | El (%) | Hole-expanding ratio λ (%) | Tensile shear strength (kN) | Cross tensile strength (kN) | Remark |
| 1 | 1 | 596 | 755 | 21.2 | 37 | 10.2 | 6.3 | Comparative Example |
| 2 | 2 | 794 | 1005 | 15.9 | 70 | 12.5 | 6.5 | Present Invention |
| 3 | 3 | 826 | 1045 | 15.3 | 65 | 13.0 | 6.4 | Present Invention |
| 4 | 4 | 860 | 1088 | 15.1 | 60 | 13.3 | 2.9 | Comparative Example |
| 5 | 5 | 841 | 1065 | 13.9 | 45 | 12.6 | 6.5 | Comparative Example |
| 6 | 6 | 806 | 1020 | 15.7 | 64 | 13.2 | 6.3 | Present Invention |
| 7 | 7 | 668 | 845 | 18.9 | 35 | 12.9 | 6.6 | Comparative Example |

TABLE 2-continued

| Steel sheet No. | Steel No. | Tensile characteristics YS (MPa) | TS (MPa) | EI (%) | Stretch-flangeability Hole-expanding ratio λ (%) | Spot-weldability Tensile shear strength (kN) | Cross tensile strength (kN) | Remark |
|---|---|---|---|---|---|---|---|---|
| 8 | 8 | 755 | 956 | 16.7 | 43 | 12.8 | 6.5 | Comparative Example |
| 9 | 9 | 818 | 1035 | 15.5 | 68 | 12.9 | 6.5 | Present Invention |
| 10 | 10 | 830 | 1050 | 15.2 | 67 | 13.3 | 6.6 | Present Invention |

Underlined figures denote those outside the range of target

EXAMPLE 2

By using steels having each of chemical compositions of steel Nos. 2, 3, 6, 9, and 10 as shown in Table 1, the steps up to cold-rolling were performed in the same manner as in Example 1 and, then, heat treatment was performed under conditions as described in Table 3 simulating the conditions of continuous annealing, thereby producing cold-rolled steel sheet Nos. A to L. Then, similar characteristics to those in Example 1 were measured.

The results are shown in Table 4.

Steel sheet Nos. B, F, H, and L according to the present invention each have a tensile strength of 980 MPa or more and are excellent in stretch-flangeability, ductility, and spot-weldability.

On the other hand, steel sheet Nos. A, C, D, E, G. I, J, and K as Comparative Examples are each inferior in at least one of these characteristics. For example, in the steel sheet No. A, since heating temperature is low, tensile strength is low. In the steel sheet No. C, since heating temperature is high, hole-expanding ratio is low. It is considered that this was caused by the fact that structure consisting mainly of martensite became coarse. In the steel sheet No. D, since heating time is short, tensile strength is low. It is considered that this was caused by the fact that sufficient amount of austenite was not generated during heating and, accordingly, sufficient amount of martensite was not able to be obtained after quenching. In the steel sheet No. E, since rapid cooling start temperature is low, tensile strength is low. It is considered that this was caused by the fact that ferrite was generated during the slow cooling and, accordingly, amount of martensite after the quenching was reduced. In the steel sheet No. G, since rapid cooling start temperature is high, tensile strength is high, while elongation is low. In the steel sheet I, since rapid cooling speed is low, tensile strength is low. In the steel sheet J, since reheating temperature is low, tensile strength is high, while elongation and stretch-flangeability are low. It is considered that this was caused by the fact that at the time of tempering treatment, such tempering of martensite was not sufficiently performed. In the steel sheet K, since reheating temperature is high, tensile strength is low.

TABLE 3

| Steel sheet No. | Steel No. | Heating temperature (° C.) | Heating time (sec) | Slow cooling speed (° C./sec) | Rapid cooling start temperature (° C.) | Rapid cooling speed (° C./sec) | Reheating temperature (° C.) | Reheating time (min) | Remark |
|---|---|---|---|---|---|---|---|---|---|
| A | 2 | 760 | 300 | 8 | 750 | 2000 | 400 | 10 | Comparative Example |
| B | 3 | 830 | 150 | 10 | 720 | 2000 | 400 | 6 | Present Invention |
| C | 6 | 890 | 200 | 16 | 710 | 2000 | 420 | 15 | Comparative Example |
| D | 9 | 830 | 5 | 13 | 690 | 2000 | 410 | 18 | Comparative Example |
| E | 10 | 830 | 270 | 12 | 620 | 2000 | 380 | 12 | Comparative Example |
| F | 6 | 830 | 120 | 7 | 700 | 2000 | 405 | 10 | Present Invention |
| G | 2 | 860 | 300 | 9 | 770 | 2000 | 390 | 16 | Comparative Example |
| H | 3 | 840 | 160 | 21 | 725 | 2000 | 410 | 15 | Present Invention |
| I | 6 | 850 | 60 | 15 | 715 | 200 | 385 | 10 | Comparative Example |
| J | 9 | 830 | 150 | 13 | 680 | 2000 | 320 | 12 | Comparative Example |
| K | 10 | 820 | 120 | 12 | 660 | 2000 | 450 | 14 | Comparative Example |
| L | 9 | 840 | 100 | 10 | 670 | 2000 | 410 | 9 | Present Invention |

TABLE 4

| Steel sheet No. | Tensile characteristics YS (MPa) | TS (MPa) | EI (%) | Stretch-flangeability Hole-expanding ratio λ (%) | Spot-weldability Tensile shear strength (kN) | Cross tensile strength (kN) | Remark |
|---|---|---|---|---|---|---|---|
| A | 541 | 685 | 23.4 | 85 | 12.5 | 6.2 | Comparative Example |
| B | 818 | 1035 | 15.5 | 67 | 13.0 | 6.5 | Present Invention |
| C | 778 | 985 | 16.2 | 44 | 13.2 | 6.3 | Comparative Example |
| D | 727 | 920 | 17.4 | 55 | 12.9 | 6.4 | Comparative Example |
| E | 668 | 845 | 18.9 | 35 | 13.0 | 6.5 | Comparative Example |
| F | 802 | 1015 | 15.8 | 70 | 13.2 | 6.2 | Present Invention |
| G | 924 | 1170 | 13.7 | 78 | 12.5 | 6.6 | Comparative Example |
| H | 798 | 1010 | 15.8 | 71 | 13.0 | 6.6 | Present Invention |
| I | 735 | 930 | 17.2 | 41 | 13.2 | 6.5 | Comparative Example |
| J | 869 | 1100 | 14.5 | 49 | 12.9 | 6.2 | Comparative Example |
| K | 851 | 950 | 16.8 | 78 | 13.0 | 6.3 | Comparative Example |
| L | 786 | 995 | 16.1 | 72 | 12.9 | 6.4 | Present Invention |

Underlined figures denote those outside the range of target

The invention claimed is:

1. A method for manufacturing an ultra high strength cold-rolled steel sheet, said steel being a ferrite martensite dual-phase steel, the method comprising continuously annealing a cold-rolled steel sheet consisting essentially of, in terms of weight percentages, 0.07 to 0.15% C, 1.4 to 2% Si, 1.8 to 3% Mn, 0.02% or less P, 0.01% or less S, 0.01 to 0.1% Sol.Al, 0.005% or less N, 0.0003 to 0.003% B, optionally at least one element selected from the group consisting of Ti and Mo, and the balance being Fe, wherein said continuous annealing comprises the steps of:

(a) heating the cold-rolled steel sheet at from 800° C. to 870° C. for 10 seconds or more to provide a heated steel sheet;

(b) slowly cooling the heated steel sheet down to from 670° C. to 750° C. to provide a slowly cooled steel sheet;

(c) rapidly cooling the slowly cooled steel sheet down to 100° C. or less at a cooling speed of over 500° C./sec to provide a rapidly cooled steel sheet;

(d) reheating the rapidly cooled steel sheet at from 325° C. to 425° C. for from 5 minutes to 20 minutes to provide a reheated steel sheet;

(e) cooling the reheated steel sheet down to room temperature to provide a cooled steel sheet; and (f) coiling the cooled steel sheet, thereby obtaining a steel sheet having a tensile strength of 980 MPa or more, a hole-expanding ratio of 60% or more and an elongation of 15% or more.

2. The method of manufacturing an ultra high strength cold-rolled steel sheet as set forth in claim 1, further containing at least one element selected from the group consisting of, in terms of weight percentages, 0.003 to 0.03% Ti and 0.1 to 1% Mo.

3. The method for manufacturing an ultra high strength cold-rolled steel sheet as set forth in claim 1, wherein step (b) is carried out at a cooling speed of less than 20° C./seconds.

4. The method for manufacturing an ultra high strength cold-rolled steel sheet as set forth in claim 1, wherein step (b) is carried out at a cooling speed of 5° C./second to 15° C./second.

5. The method for manufacturing an ultra high strength cold-rolled steel sheet as set forth in claim 1, further comprising before the continuous annealing, producing a steel sheet by a continuous casting method or an ingot making method, cooling the steel sheet, reheating the steel sheet, hot-rolling the steel sheet and cold-rolling the steel sheet, wherein in the hot-rolling, a finish rolling temperature is from the $Ar_3$ transformation temperature to 870° C.

6. The method for manufacturing an ultra high strength cold-rolled steel sheet as set forth in claim 1, further comprising after the continuous annealing, temper-rolling the steel sheet at a rolling reduction rate of 0.1 to 0.7%.

7. The method for manufacturing an ultra high strength cold-rolled steel sheet as set forth in claim 1, wherein the steel sheet contains 0.12 weight % of said C, 2.1 weight % of said Mn, 0.010 weight % of said P, 0.003 weight % of said S, 0.030 weight % of said Sol.Al, 0.003 weight % of said N, 0.0010 weight % of said B, less than 0.001 weight % of said Ti and less than 0.001 weight % of said Mo.

8. The method for manufacturing an ultra high strength cold-rolled steel sheet as set forth in claim 1, wherein the steel sheet has a composition of 0.13 weight % C, 1.4 weight % Si, 1.9 weight % Mn, 0.010 weight % P, 0.003 weight % S, 0.030 weight % Sol.Al, 0.003 weight % N, 0.0010 weight % B, less than 0.001 weight % Ti, less than 0.001 weight % Mo, and the balance being Fe.

9. The method for manufacturing an ultra high strength cold-rolled steel sheet as set forth in claim 1, wherein the steel sheet contains 0.12 weight % C , 2.2 weight % of said Mn, 0.010 weight % of said P, 0.003 weight % of said S, 0.030 weight % of said Sol.Al, 0.003 weight % of said N, 0.0010 weight % of said B, 0.02 weight % of said Ti and less than 0.001 weight % of said Mo.

10. The method for manufacturing an ultra high strength cold-rolled steel sheet as set forth in claim 1, wherein the steel sheet contains 0.12 weight % of said C, 1.9 weight % of said Mn, 0.010 weight % of said P, 0.003 weight % of said S, 0.030 weight % of said Sol.Al, 0.003 weight % of said N, 0.0010 weight % of said B, 0.30 weight % of said Mo and less than 0.001 weight % of said Ti.

11. The method for manufacturing an ultra high strength cold-rolled steel sheet as set forth in claim 1, wherein the steel sheet further contains 0.003 to 0.03 weight % Ti.

12. The method for manufacturing an ultra high strength cold-rolled steel sheet as set forth in claim 1, wherein the steel sheet further contains 0.1 to 1 weight % Mo.

13. The method for manufacturing an ultra high strength cold-rolled steel sheet as set forth in claim 1, wherein in step (a), the cold-rolled steel sheet is heated at a heating speed of about 20° C./second, at 830° C. for 300 seconds; in step (b), the heated steel sheet is cooled to 700° C. at a cooling speed at about 10° C./second; in step (c), the slowly cooled steel sheet is rapidly cooled in water at a cooling speed of about 2000° C./second; and in step (d), the rapidly cooled steel sheet is subject to reheating at 400° C. for 10 minutes.

14. The method for manufacturing an ultra high strength cold-rolled steel sheet as set forth in claim 7, wherein in step (a), the heating is carried out at 830° C. for 150 seconds; in step (b), the slowly cooling is carried out at a cooling speed of 10° C./seconds; in step (c), the rapidly cooling starts at a temperature of 720° C. and is carried out at a cooling speed of 2000° C./second; and in step (d), the reheating is carried out at a temperature of 400° C. for 6 minutes.

15. The method for manufacturing an ultra high strength cold-rolled steel sheet as set forth in claim 8, wherein in step (a), the heating is carried out at 830° C. for 120 seconds; in step (b) the slowly cooling is carried out at a cooling speed of 7° C./seconds; in step (c), the rapidly cooling starts at a temperature of 700° C. and is carried out at a cooling speed of 2000° C./seconds; and in step (d), the reheating is carried out at a temperature of 405° C. for 10 minutes.

16. The method for manufacturing an ultra high strength cold-rolled steel sheet as set forth in claim 7, wherein in step (a), the heating is carried out at 840° C. for 160 seconds; in step (b), the slowly cooling is carried out at a cooling speed of 21° C./seconds; in step (c), the rapidly cooling starts at a temperature of 725° C. and is carried out at a cooling speed of 2000° C./second; and in step (d), the reheating is carried out at a temperature of 410° C. for 15 minutes.

17. The method for manufacturing an ultra high strength cold-rolled steel sheet as set forth in claim 9, wherein in step (a), the heating is carried out at 840° C. for 100 seconds; in step (b), the slowly cooling is carried out at a cooling speed of 10° C./seconds; in step (c), the rapidly cooling starts at a temperature of 670° C. and is carried out at a cooling speed of 2000° C./second; and in step (d), the reheating is carried out at a temperature of 410° C. for 9 minutes.

18. The method for manufacturing an ultra high strength cold-rolled steel sheet as set forth in claim 1, wherein C is in an amount of 0.12 to 0.15 weight %.

* * * * *